US006113052A

United States Patent [19]

Gentile et al.

[11] Patent Number: 6,113,052

[45] Date of Patent: Sep. 5, 2000

[54] PORTABLE DESK

[75] Inventors: Luigi Gentile, Los Angeles; Bradford T. Sorensen, Glendale, both of Calif.

[73] Assignee: Luigi Gentile, Los Angeles, Calif.

[21] Appl. No.: 09/335,394

[22] Filed: Jun. 17, 1999

Related U.S. Application Data

[63] Continuation-in-part of application No. 09/152,946, Sep. 14, 1998, abandoned.

[51] Int. Cl.[7] ..... A47G 1/24

[52] U.S. Cl. ..... 248/456; 108/9; 248/460

[58] Field of Search ..... 108/1, 43, 11, 108/9, 42, 6, 49; 211/41.7, 43; 248/460, 454, 455, 466, 688, 165

[56] References Cited

U.S. PATENT DOCUMENTS

| | | | |
|---|---|---|---|
| D. 341,958 | 12/1993 | Allred . | |
| 674,668 | 5/1901 | Bisler . | |
| 1,485,786 | 3/1924 | Kraft . | |
| 1,848,854 | 3/1932 | Urich . | |
| 2,478,849 | 8/1949 | Thompson . | |
| 3,147,949 | 9/1964 | Webster . | |
| 3,652,051 | 3/1972 | McFarlane . | |
| 3,813,074 | 5/1974 | Mulvaney . | |
| 3,821,936 | 7/1974 | Morse . | |
| 3,951,374 | 4/1976 | Quigley . | |
| 4,044,980 | 8/1977 | Cummins | 248/460 |
| 4,216,936 | 8/1980 | DeSelms | 248/460 |
| 5,129,715 | 7/1992 | Maynard, Jr. . | |
| 5,165,648 | 11/1992 | Quigley . | |
| 5,290,003 | 3/1994 | Reyes | 248/461 |
| 5,451,025 | 9/1995 | Hames | 248/456 |
| 5,516,072 | 5/1996 | Shinno . | |
| 5,607,135 | 3/1997 | Yamada | 248/455 |

*Primary Examiner*—Peter M. Cuomo
*Assistant Examiner*—Jerry A. Anderson
*Attorney, Agent, or Firm*—Sheldon & Mak

[57] ABSTRACT

The present invention provides a lightweight and inexpensive portable desk useful as a support for an article, a book, a magazine, a lap-top computer, a drawing, a photograph, a painting, writing utensils, and the like. The portable desk comprises just two integral components, a desk member and a leg member. Some unique features of the portable desk of the present invention include: 1) a capacity to vary the tilt angle according to the needs of a particular user and work setting and 2) the leg member serves as a base to support the desk member and includes a projection that allows for efficient storage/transportation of the portable desk. Thus, the portable desk of provides several working configuration at various inclinations and can be assembled in a securely connected compact storage/transportation configuration.

23 Claims, 6 Drawing Sheets

FIG. 1
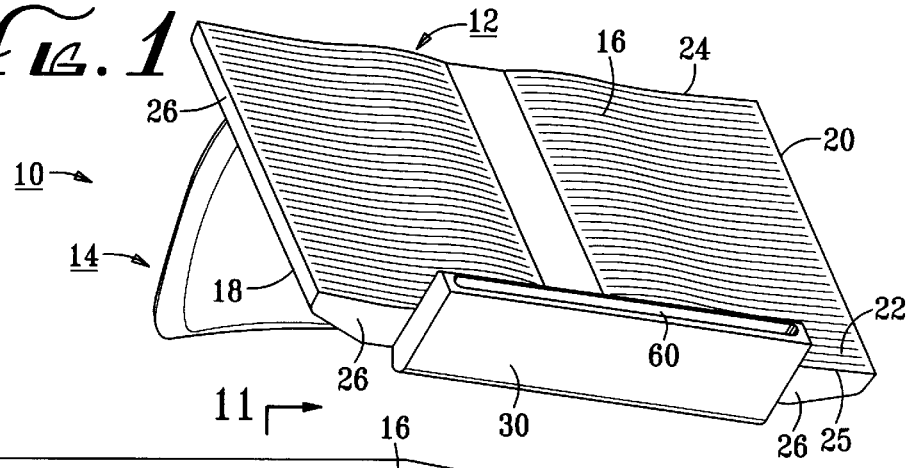
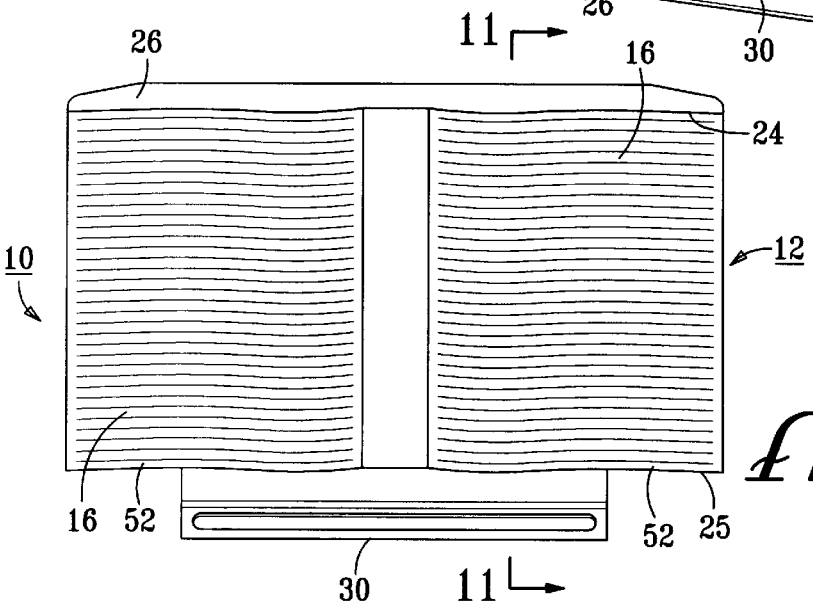
FIG. 2
FIG. 3
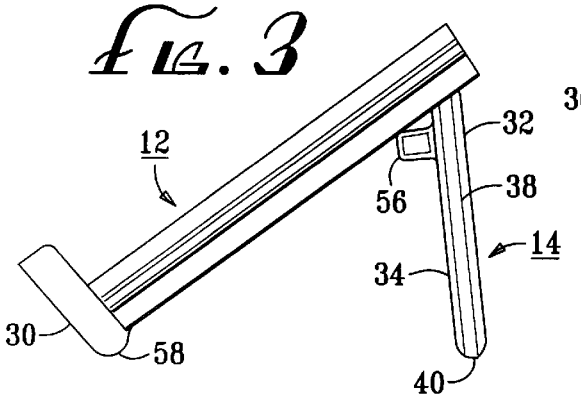
FIG. 11
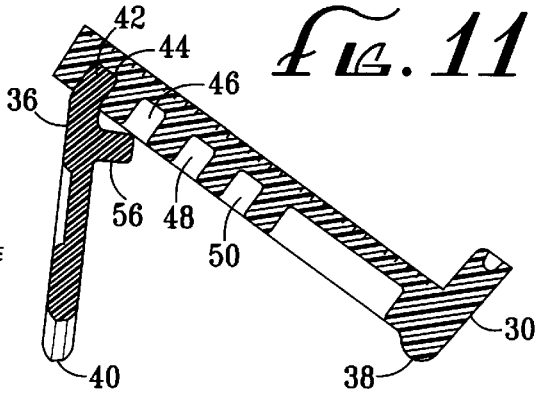

FIG. 13
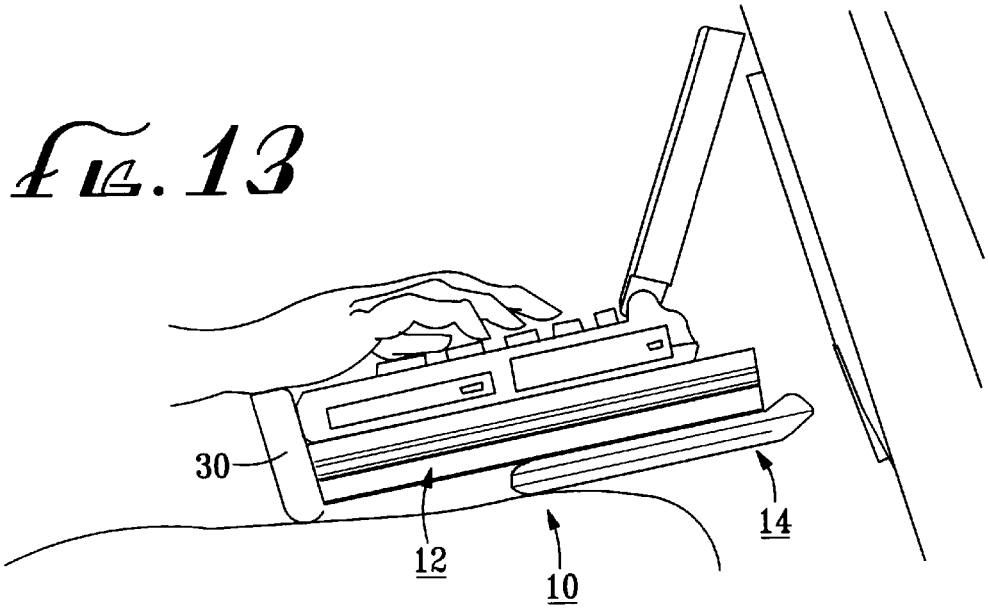
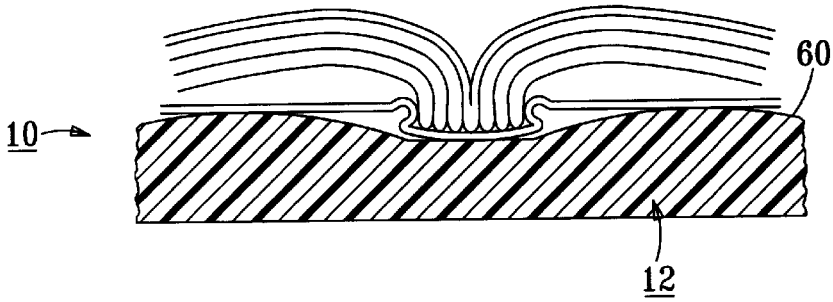
FIG. 14
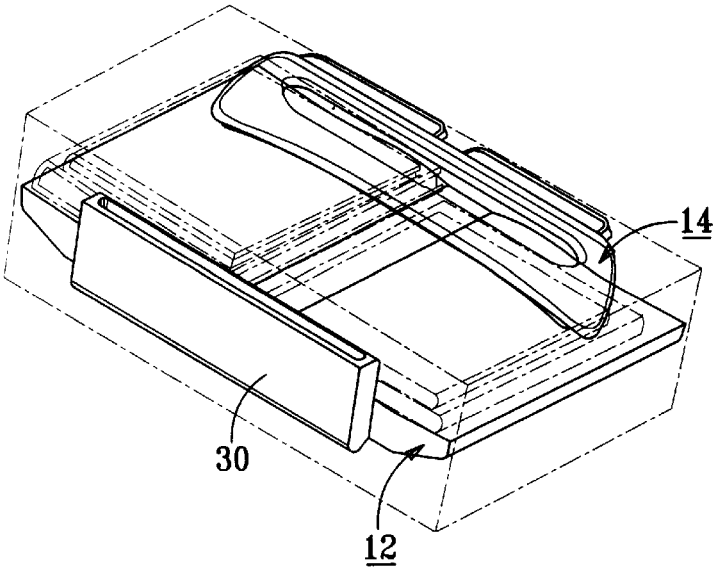
FIG. 15

FIG. 10A
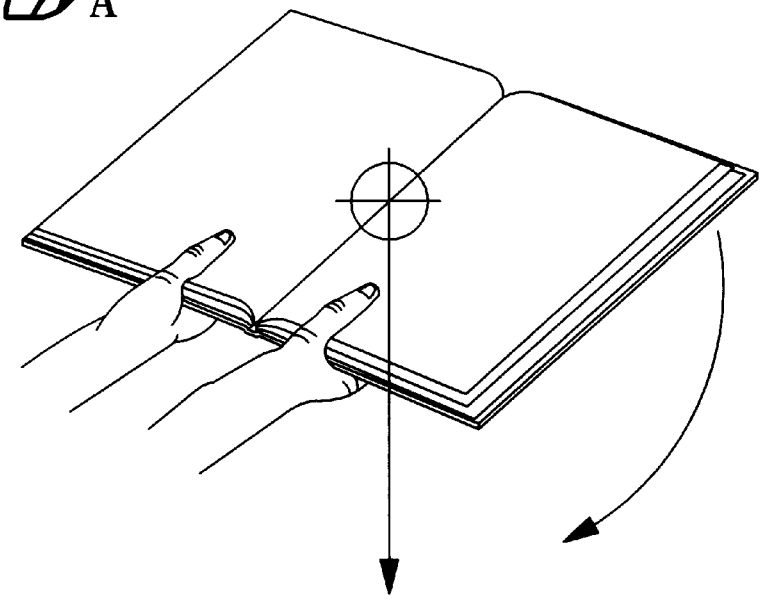
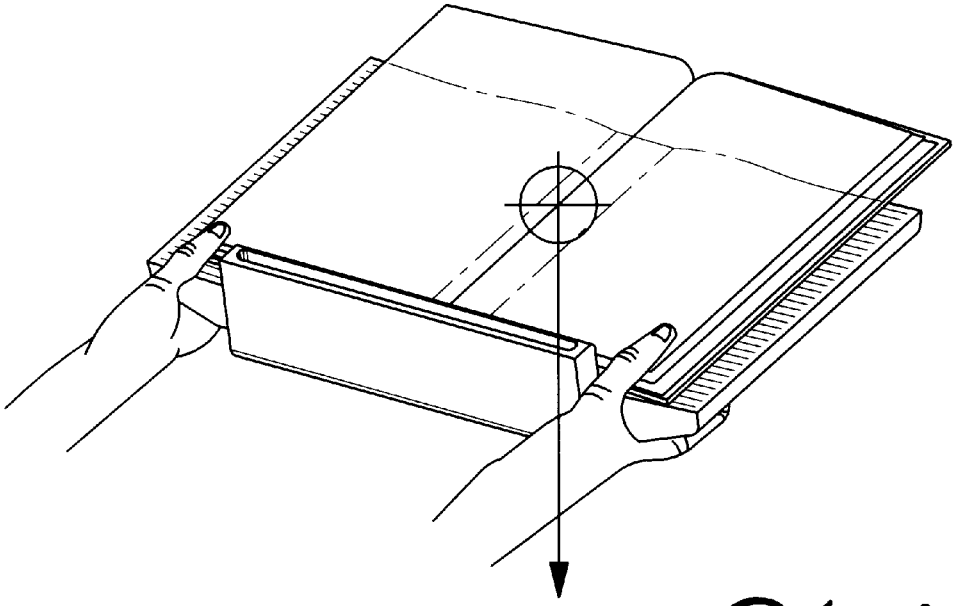
FIG. 10B

PORTABLE DESK

CROSS REFERENCE TO RELATED APPLICATIONS

The present application is a Continuation-In-Part of U.S. patent application Ser. No. 09/152,946, filed on Sep. 14, 1998, now abandoned the content of which is incorporated herein by reference in its entirety.

BACKGROUND

This invention relates to a portable desk for supporting an article such as a book, a magazine, a lap-top computer, a drawing, a photograph, a painting, writing utensils, and the like.

Attempts have been made to develop such a portable desk; see, for example, U.S. Pat. Nos. 3,147,949, 5,165,648, and 5,516,072. These prior devices suffer from one or more deficiencies such as excessive bulk, heavy to carry, costly, providing only one angle of inclination for mounting articles, and lack of a compact storage and transport configuration.

Accordingly, there is a need for a lightweight, inexpensive portable desk that can be used in a working configuration at various inclinations, and can be assembled in a securely connected, compact storage configuration.

SUMMARY

The present invention is directed to a portable desk that satisfies this need. The portable desk can be used as a lap-board or can be placed on a desk or support surface. The device includes two separate members which are held together both when the desk member is collapsed and when it is erected, therefore making it difficult for pieces to be lost.

According to the invention, there is provided a portable desk comprising a desk member and one removable leg. The desk member has a front surface, a back surface, a bottom portion, a top portion, side walls, and preferably a protruding ledge, positioned at the bottom portion of the front surface of the desk member, for maintaining an article on the upper surface when the desk member is tilted or in use. The desk member also comprises several openings located on its back surface for insertion of the top portion of the leg member. The leg member inserts into one of these openings for supporting the desk member in one of several working configurations, i.e., a first working configuration, a second working configuration, etc. This inventive feature of the portable desk of the present invention allows the tilt angle of the desk member to be varied so as to better accommodate the user in a variety of work settings merely by inserting the removable leg into one of the several openings located on the back surface of the desk member. Additionally, the back surface of the desk member preferably comprises finger holes useful for positioning and maneuvering the portable desk.

The removable leg comprises a front surface, a back-side surface, a top portion, side walls, and a base for resting on a surface. The top portion of the leg preferably comprises an angled extension used for insertion of the leg member into an opening located on the back surface of the desk member so as to assemble the portable desk in one of several working configurations. The base of the leg member preferably comprises semi-circular, or near semi-circular arch or arches to enable the base of the removable leg to be placed comfortably over the thighs of a user. Further, there is an extending projection preferably located on the back-side surface of the leg member. This extending projection is a unique feature of the portable desk of the present invention which enables the leg member to be inserted into one of several openings on the back surface of the desk member for supporting the desk member in a nearly flat storage and/or transportation configuration.

Preferably, the desk is made of an inexpensive, light-weight material such as expanded cellular polystyrene.

Thus, there is provided a portable desk that is simple in construction, easily assembled, lightweight, inexpensive, with the capacity to accommodate a variety of users in numerous settings by varying the tilt angle, and has a compact storage/transport configuration.

DRAWINGS

These and other features, aspects and advantages of the present invention will become better understood from the following description, appended claims, and accompanying drawings where:

FIG. 1 is a perspective view of a support for a book or similar article, according to the present invention, having a removable leg, the leg being in a use position, wherein the leg is inserted into an opening on the back surface of the desk member.

FIG. 2 is a top plan view of the support as shown in FIG. 1.

FIG. 3 is a side elevation view of the support as shown in FIG. 1, wherein the opposing side is not shown since it is a mirror image of the view of FIG. 3.

FIG. 11 is a cross-sectional view of the portable desk depicted in FIG. 3, wherein the angled extension of the top portion of the leg member is shown inserted into the first, box-shaped opening located on the back surface of the desk member so as to support the portable desk in a first working configuration.

FIG. 13 illustrates the portable desk being used to support a lap-top computer during travel in its storage/transportation configuration; the figure further illustrates how the ledge of the portable desk ergonomically supports the wrist of the user.

FIG. 14 illustrates a cross-sectional view of the portable desk supporting a book; the figure further illustrates how a book binding and book flaps are accommodated by the curved, front surface of the portable desk.

FIG. 15 depicts the portable desk being utilized as a packing structure for shipping books.

FIG. 16A illustrates the position of the center of gravity when a user is supporting a book without the use of the portable desk of the present invention.

FIG. 16B illustrates the position of the center of gravity when a user is supporting a book with the use of the portable desk of the present invention.

DESCRIPTION

Figure 4:
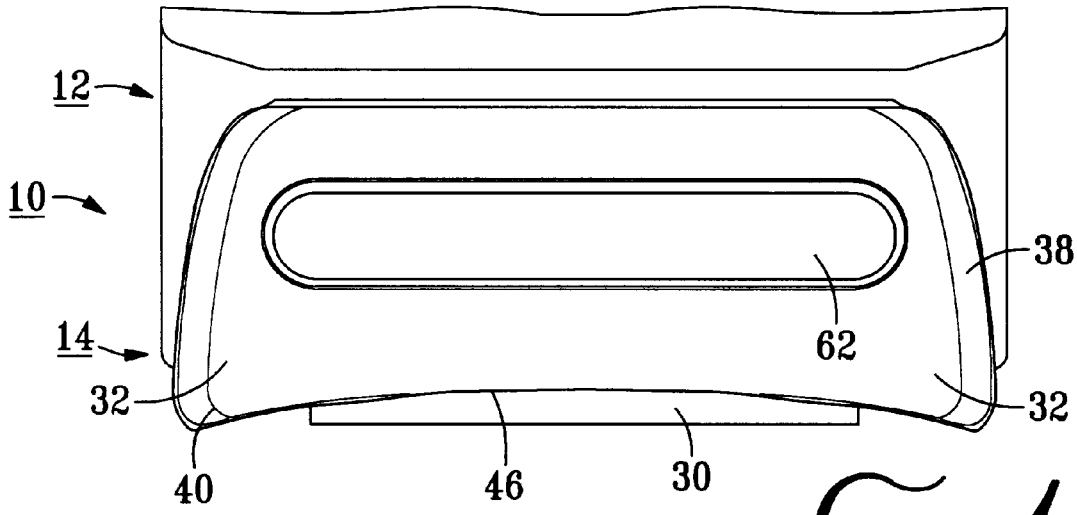
FIG. 4 is a rear elevation view of the support as shown in FIG. 1.

Referring to the Figures, a portable desk 10 in accordance with a preferred version of the present invention comprises, as its major components, a desk member 12 and a removable leg 14. The desk member 12 has a front surface 16, a back surface 18, a top portion 20, a bottom portion 22, a top edge 24, a bottom edge 25, and side walls 26. The desk member 12 includes an integrally formed upwardly extending ledge 30 for supporting the lower portion of an article such as a book (not shown).

The removable leg 14 comprises a front surface 32, a back-side surface 34, a top portion 36, side walls 38, and a base 40. As shown in FIGS. 3 and 11, the leg 14 comprises an angled extension 42, positioned at an angle relative to the back-side surface 34 of the leg member 14, for insertion into a correspondingly shaped leg-attachment opening 44 in the desk member 12 so as to provide support for the desk member 12 in its first working configuration. If the top portion 36 of the leg member 14 is not angled, the positioning of the leg member 14 so as to assemble the portable desk 10 in one of its working configurations, may be reversed. Preferably, the top portion 36 is at an acute angle relative to the back-side surface 34 of the leg member, as revealed in the cross-sectional view, shown in FIG. 11. Also illustrated in FIGS. 3 and 11, the leg member further comprises an extending projection 56 located on the back-side surface 34 of the leg. This extending projection 56 is used to support the portable desk 10 in its storage and/or transportation configuration, as shown in FIGS. 6–10 and 12.

Figure 5:
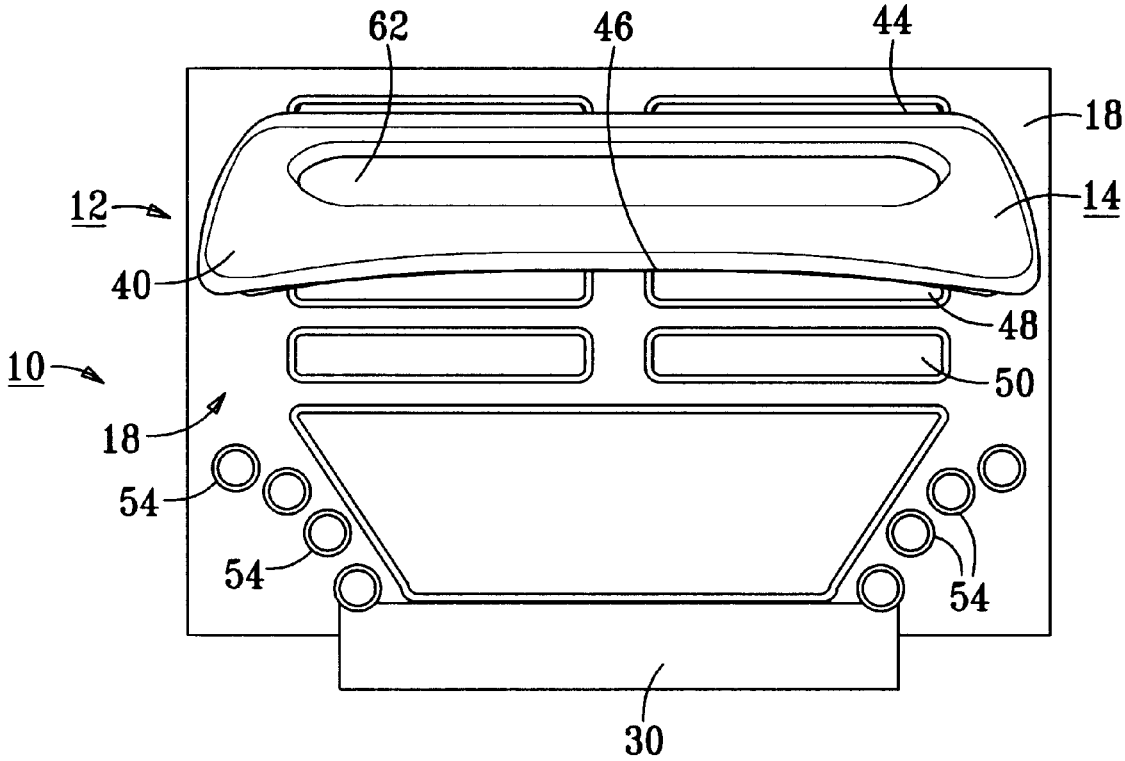
FIG. 5 is a bottom plan view of the support as shown in FIG. 1.
Figure 6:
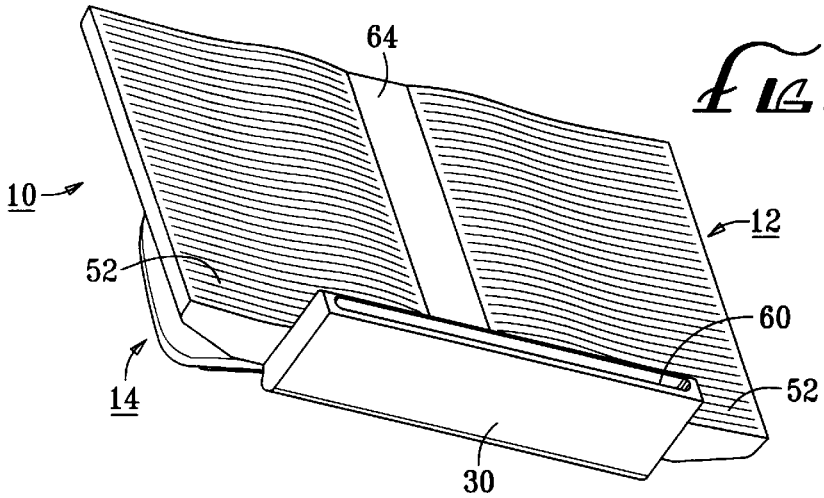
FIG. 6 is a perspective view of the support of FIG. 1 in a storage configuration wherein the leg is not in use and wherein the extending projection is inserted into an opening on the back surface of the desk member as shown in FIG. 5.
Figure 7:
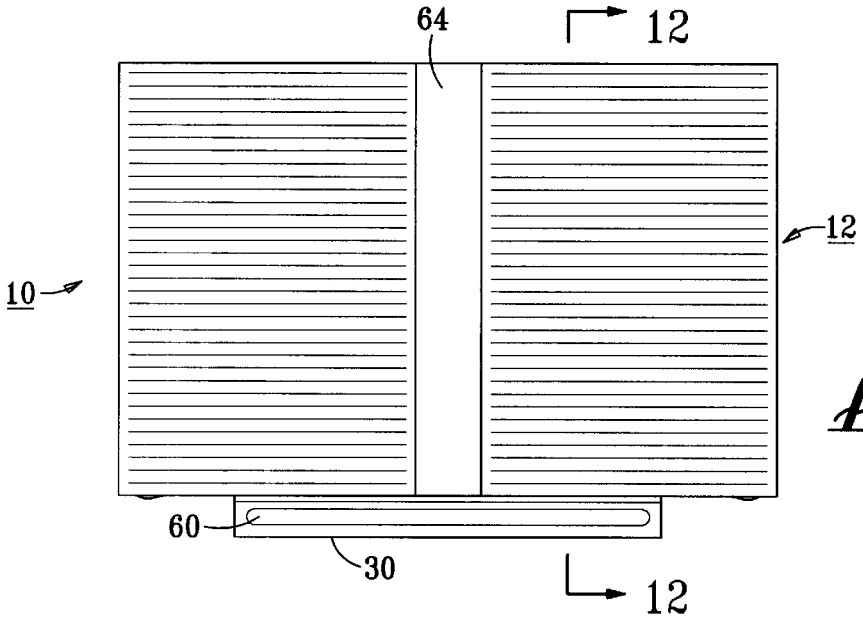
FIG. 7 is a top plan view of the support as shown in FIG. 6.

Referring to FIG. 5, the angled extension 42 of the removable leg 14 is depicted inserted into a first open box-shaped opening 44 of the desk member to support the desk member 12 in a first working configuration. Here the desk member 12 is inclined at a first acute angle relative to a support surface. The leg member, however, can be inserted into either a second opening 46, a third opening 48, or a fourth opening 50 on the back surface 18 of the desk member 12 so as to vary the angle of inclination of the desk member relative to the support surface as needed by a particular user in a particular setting.

Although FIG. 5 depicts an embodiment of the portable desk with four openings on the back surface of the desk member for attachment of the leg, other embodiments of the present invention are envisioned wherein the desk member has more or less openings. Preferably, the portable desk of the present invention comprises 2–6 openings, located on the back surface 18 of the desk member 12 for attachment of the leg member 14.

Figure 10:
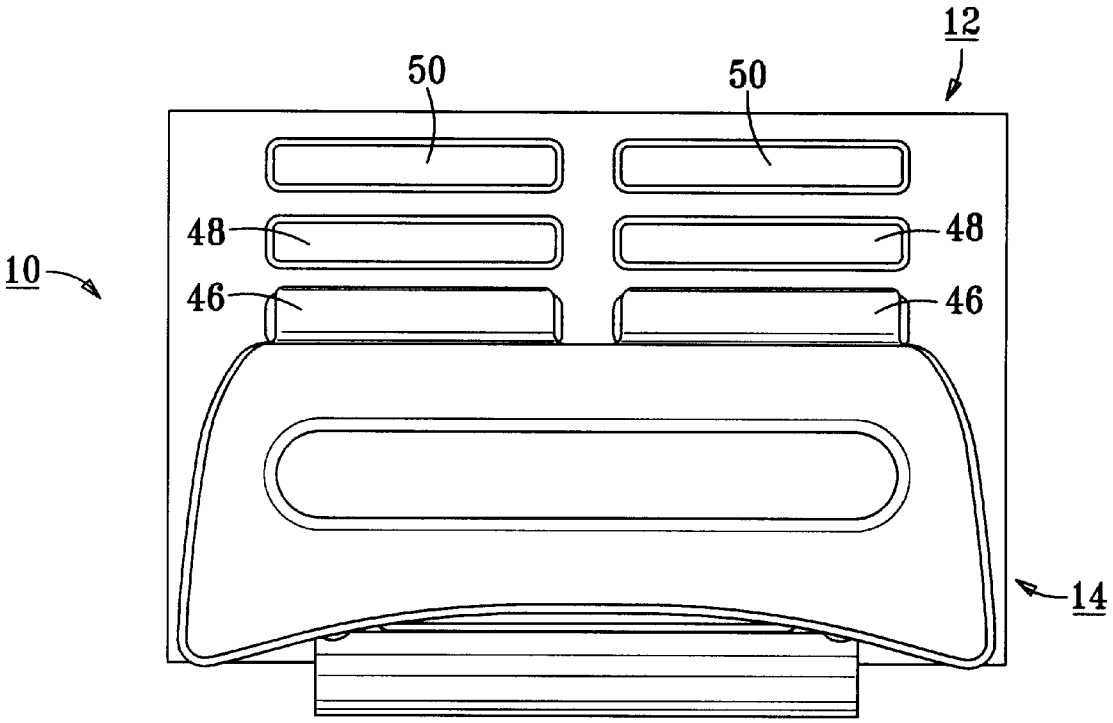
FIG. 10 is a bottom plan view of the support as shown in FIG. 6.

As shown in FIGS. 4, 5 and 10, preferably the base 40 of the leg 14 comprises one or two nearly semi-circular arch or arches 46 for placement over the thighs of a user while the user is seated. Preferably, the arch or arches 46 are sufficiently deep to provide stability for the portable desk while a user is working on an article. However, the portable desk 10 in this first working configuration, or in any other configuration, also can be used on a planar surface, such as the top of a conventional table.

As shown in FIGS. 1, 2, 5, 6 and 7, preferably the width of the ledge 30 is less than the width of the desk member 12 with an end segment 52 of the desk member extending beyond each end of the ledge. This permits the user to grasp an oversized book and the desk member simultaneously for moving both together, as illustrated in FIG. 16B. Also to facilitate the handling and maneuvering of the portable desk, it is preferred that finger holes be positioned on each side of the lower back surface of the desk member, as shown in FIG. 5. However, the location of the finger holes 54 also may be positioned on any other suitable portion of the back surface of the desk member 12.

The ledge 30 also extends outward from the back surface 18 of the portable desk 10 to form a support foot 58 that elevates the bottom edge 25 of the portable desk 10 permitting clearance for sliding fingers under the right and left sides of the bottom edge 25 to facilitate lifting.

Additionally, the ledge 30 prevents the sliding of a book, article or utensils that can be supported on the front surface 16 of the desk member 12. Moreover, this protruding ledge 30 is sufficiently thick to withstand the weight of a heavy article, such as a lap-top computer or heavy book. A slot 60 is provided in the ledge 30 for placement of a pencil, pen or other writing instrument.

The present invention has another unique function not identifiable from first impressions. When the portable desk 10 has a heavy or cumbersome article placed on the front surface 16 of desk member 12, the heavy article, such as a large book or lap top computer, rests on, or is supported by, the ledge 30. In this position, gravity secures the heavy article to the portable desk 10. The bottom foot extension 58 supports and elevates the right and left edges of the portable desk 10, allowing clearance for the left and right hands of the user to move in under the center of gravity of the heavy article. This gap, on either side, left by the placement of the ledge, therefore, facilitates lifting and maneuvering of the article. Without the portable desk 10, the hands of the user lift the bottom edge of the book leaving the center of gravity over empty space instead of over the hands.

These aspects of the design of the present invention are illustrated in FIGS. 16A and 16B. FIG. 16A depicts the handling of a cumbersome book without the aid of the portable desk of the present invention. In FIG. 16A, it is shown that given the position of the center of gravity of the book, a gravitational pull in the downward direction is directed to the wrists of the user causing possible wrist strain. In this illustration it is estimated that leverage is working against the book user on the order of approximately three times the weight of the book. In contrast, when the same article is supported by the portable desk of the present invention, as depicted in FIG. 16B, the gravitational pull caused by the center of gravity is counterbalanced by the positioning of the hands of the user at the edge of the front and back surfaces of the desk member. Thus, the wrist strain that would normally be experienced when maneuvering a heavy article, such as a book or a lap-top computer, is greatly diminished when the user is assisted by the portable desk, thus providing an ergonomic feature of the present invention. Aiding in providing this ergonomic feature is the overall fit of the book with the desk member 12, as illustrated in FIG. 14, where the book binding is accommodated by the curved front surface 16 of the portable desk.

Furthermore, by placing a lap top computer on the top surface of the desk member 12 with the front edge of the lap top computer keyboard resting on the ledge 30, the computer and the ledge 30 are positioned at approximately the same level. This matching of heights forms an enlarged surface upon which to rest the wrists of the laptop computer user while typing or performing other keyboard inputting. This support for the wrists provides an enhanced ergonomic benefit to the user. Thus, as illustrated in FIG. 13, the portable desk of the present invention additionally provide extended support that can reduce carpal tunnel syndrome of the tendons and other types of tendinitis, and/or reduce shoulder and neck stress.

Figure 8:
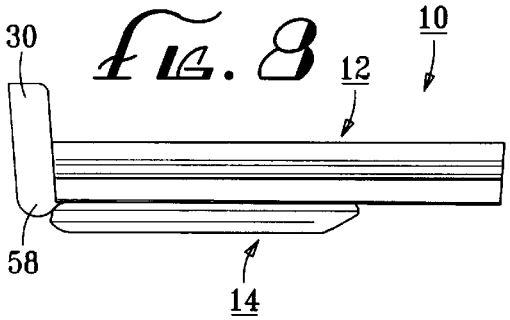
FIG. 8 is a side elevation view of the support as shown in FIG. 6, wherein the opposing side is not shown since it is a mirror image of the view of FIG. 8.
Figure 12:
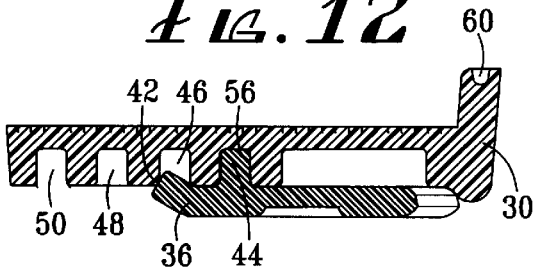
FIG. 12 is a cross-sectional view of the portable desk depicted in FIG. 8, wherein the extending projection located on the back-side surface of the leg member is shown inserted in the fourth, box-shaped opening located on the back surface of the desk member so as to support the portable desk in a storage/transportation configuration.
Figure 9:
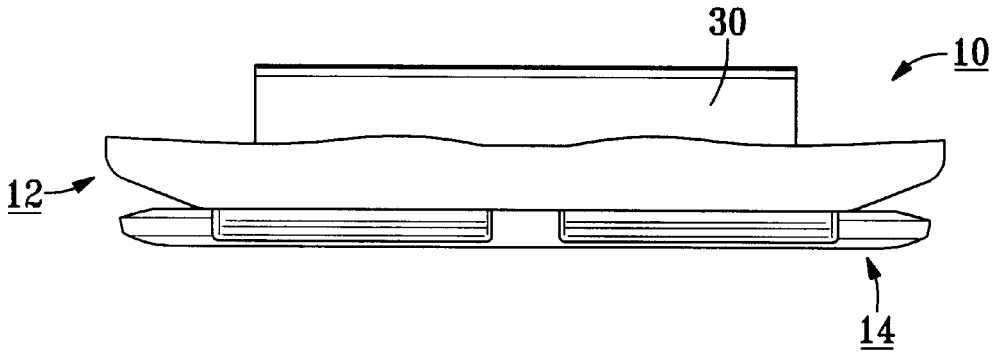
FIG. 9 is a rear elevation view of the support as shown in FIG. 6.

FIGS. 6–10, 12 and 15 depict the portable desk of the present invention in its compact storage and/or transportation configuration where the extending projection 56 located on the back-side 34 of the leg member is inserted into an opening on the back surface 18 of the desk member. In particular FIGS. 8, 9, 10 and 12 illustrate the compactness of the overall configuration when the extending projection is inserted into an opening for storage and transportation of the portable desk. The compact storage configuration enables a user to easily carry and store the desk when it is not in use in a working configuration. In this storage/transportation configuration, as shown in FIGS. 8–10, the openings 44–50 in the desk also can be used as a handle for carrying the desk, merely by the user inserting his hand into an opening. Additionally, the finger holes 54, shown in FIG. 10, can be used for this purpose. This allows the portable desk 10, in the storage configuration, to be easily carried about. Moreover, this storage/transportation mode provides a space-effective method for attaching the components of the desk so as to minimize their unwanted dissociation.

Additionally, the storage and/or transportation configuration of the portable desk of the present invention can be utilized as a working configuration as illustrated in FIG. 13. This storage/transportation mode also has other uses, as illustrated in FIG. 15, where the portable desk is depicted being used as packing material for shipping books or other articles.

The components of the portable desk 10 can be made from a variety of polymeric materials, but preferably are made of Styrofoam brand expanded cellular polystyrene or other lightweight inexpensive material. Optionally, they can be made of molded fiberglass, molded plastic, or other synthetic resins. Additionally, the components can be made of wood or metal. Moreover, for strength, low cost, and ease of manufacture, preferably the ledge 30 is integral to the remainder of the desk member 12 and is formed as a single element of monocoque construction.

The above described versions of the present invention have many advantages, including the removable leg 14, which can be attached in a position to use the desk member on a hard surface or legs of a user, or can be attached in a nearly flat position to easily carry and store the portable desk. The desk is easily assembled, and the preferred foam material produces a lightweight and inexpensive device that can be readily constructed, manufactured and produced with ease of handling in either its working configuration or its storage and/or transport configuration.

Additionally, the lightweight construction of the portable desk of the present invention has safety advantages as compared with prior art portable desks, which were generally made of wood and other heavy materials. The portable desk of the present invention will not cause injury if accidentally dropped by the user.

Optionally, the desk member 12, as well as the leg member 14, can be provided with a logo or other design for decorative purposes, or to bear a trademark or service mark, thereby allowing the desk to be sold and distributed for promotional purposes. The leg member 14 is provided with an area for a logo attachment 62. The desk member also has an area for logo attachment 64.

Although the present invention has been described in considerable detail with reference to certain preferred versions thereof, other versions are possible. For example, the front surface 16 of the desk member 12 can be curved or flat, the leg member 14 may have an angled or straight extension located on its top portion, the ledge 30 of the desk member 12 can be one rectangular ledge or, alternatively, a non-continuous ledge with separate blocks spaced apart along the upper planar surface 16 of the desk member 12. Furthermore, the ledge 30 can be of monocoque construction with the remainder of the desk member, or removably positionable on the desk member 12. Additionally, the open box slot-shaped openings 44–50 of the desk member 12 and the rectangular block, angled extension 42 of the removable leg 14 can vary in shape and size and consist of more or less than the openings described herein. Moreover, extending projection 56 of the leg member can vary in shape, size and angle relative to the back-side of the leg member. Although the portable desk 10 is preferably formed from foam to provide a lightweight and inexpensive device, the desk may be constructed of other inexpensive materials. Therefore, the spirit and scope of the appended claims should not be limited to the description of the preferred versions contained herein.

All features disclosed in the specification, including the claims, abstracts, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

Any element is a claim that does not explicitly state "means" for performing a specified function, or "step" for performing a specified function, should not be interpreted as a "means " or "step" clause as specified in 35 U.S.C. §112.

What is claimed is:

1. A portable desk comprising:

(a) a desk member having a front surface for supporting an article and a back surface comprising at least one opening; and (b) a leg member comprising a top portion, a base, and a back-side surface, the top portion being removably positionable said at least one opening for supporting the desk member in a working configuration on a support surface, and the back-side surface having a projection removably positionable in said at least one opening when supporting the portable desk in a storage and/or transportation configuration.

2. The portable desk of claim 1, wherein the top portion of the leg member further comprises an angled extension positioned at an acute angle relative to the back-side surface of the leg.

3. The portable desk of claim 2 having a ledge with a groove suitable for removably storing a pencil, pen or other writing instrument.

4. The portable desk of claim 1, further comprising an upwardly extending ledge at a bottom portion of the front surface of the desk member.

5. The portable desk of claim 4, wherein the ledge provides ergonomic support for a user.

6. The portable desk of claim 4, wherein the ledge is integral with the portable desk.

7. The portable desk of claim 4, wherein the width of the ledge is less than the width of the desk member, whereby there is an end segment of the desk member extending beyond each end of the ledge.

8. The portable desk of claim 1, wherein the projection is aligned substantially perpendicular to the back-side surface of the leg member.

9. The portable desk of claim 1, in which the base of the leg comprises at least one substantially semi-circular arch to enable the desk to be comfortably placed over the thighs of a user while the user is in a seated position.

10. The portable desk of claim 1 wherein the function of the present invention would be that of a display easel.

11. The portable desk of claim 10 wherein the ledge or groove may be utilized as a mounting surface for signage or other advising indicia.

12. The portable desk of claim 1, wherein the desk member and/or leg member contains an advertising indicia.

13. The portable desk of claim 1, wherein the back surface of the desk member has openings located near one or more edges of the back surface for finger placement and handling of the portable desk.

14. The portable desk of claim 1, wherein the desk member or leg member is of monocoque construction.

15. The portable desk of claim 1, wherein the desk member or leg member, or both are made of a foam material.

16. The portable desk of claim 15, wherein the foam material comprises a polystyrene material.

17. The portable desk of claim 1, wherein one or both of the components comprise a construction material selected from the group consisting of fiberglass, plastic, wood, or metal.

18. A method for an individual to work on an article while seated comprising:

(a) selecting the portable desk of claim 1;

(b) placing the top portion of the leg member into the opening of the desk member to assemble the desk into its first working configuration;

(c) placing the near semi-circular arch or arches of the leg member on the thighs of the individual; and (d) placing the article on the front surface of the desk member.

19. The method of claim 18, further comprising disassembling the leg member from the desk member, and subsequently reconnecting the desk member to the projection on the leg member, so as to use the portable desk in its storage and/or transportation configuration.

20. A method for an individual to work on an article comprising:

(a) selecting the portable desk of claim 1;

(b) placing the top portion of the leg into the opening of the desk member;

(c) placing the base of the leg on a support surface; and (d) placing the article on the front surface of the desk member.

21. A method for an individual to use, transport and store a portable desk in a compact configuration comprising:

(a) selecting the desk of claim 1; and (b) inserting the projection of the leg member into an opening on the back surface of the desk member.

22. A portable desk comprising:

(a) a desk member having a front surface for supporting an article and a back surface comprising 2–6 openings, wherein the openings are open boxed-shaped slots, located on the back surface of the desk member, and used to vary the tilt angle of the portable desk in one of several working configurations; and (b) a leg member comprising a top portion, a base, and a back-side surface, the top portion being further comprising an angled extension relative to the back-side surface, and being removably positionable in at least one of the openings for supporting the desk member in one or more working configurations on a support surface, wherein each working configuration comprises a different tilt angle that results from inserting the angled extension of the top portion into a particular opening, and the back-side surface having a projection removably positionable in at least one of the openings when supporting the portable desk in a storage and/or transportation configuration.

23. The portable desk of claim 22, wherein the number of openings is four.

* * * * *